United States Patent [19]

Johnson, Jr. et al.

[11] 4,436,227

[45] Mar. 13, 1984

[54] PUMP AND TAP ASSEMBLY FOR BEVERAGE CONTAINERS

[75] Inventors: Arthur L. Johnson, Jr.; Marlow W. Dodge, both of Rockford, Ill.

[73] Assignee: Johnson Enterprises, Inc., Rockford, Ill.

[21] Appl. No.: 307,535

[22] Filed: Oct. 1, 1981

[51] Int. Cl.[3] ..... B67D 5/42

[52] U.S. Cl. ..... 222/382; 222/384; 222/400.8

[58] Field of Search ..... 222/400.7, 384, 382, 222/400.8, 341, 209; 137/212

[56] References Cited

U.S. PATENT DOCUMENTS

| | | | |
|---|---|---|---|
| 1,750,512 | 3/1930 | Ewald | 222/400.7 |
| 2,312,067 | 2/1943 | Bates | 222/400.8 X |
| 4,119,244 | 10/1978 | Funke | 222/400.8 |
| 4,350,273 | 9/1982 | Nezworski et al. | 222/400.7 X |

*Primary Examiner*—Stanley H. Tollberg

*Attorney, Agent, or Firm*—Leydig, Voit, Osann, Mayer & Holt, Ltd.

[57] ABSTRACT

A combined pump and tap assembly for a beverage container includes a cylinder for a hand pump and a gas tube projecting downwardly from the bottom wall of the cylinder and communicating with the interior of the latter. A hollow boss rigid with the bottom wall provides a connection for a downwardly projecting draw tube and a fitting for a dispensing hose is rigid with the boss and communicates with the draw tube through the boss. The cylinder, its bottom wall, the boss and the fitting are made as an integral unitary part so as to effectively preclude the user from disabling the hand pump and connecting the gas tube to another pressure source which may be unregulated and cause the container to explode.

1 Claim, 4 Drawing Figures

PUMP AND TAP ASSEMBLYFOR BEVERAGE CONTAINERS

BACKGROUND OF THE INVENTION

This invention relates to a combined pump and tap assembly for dispensing a beverage, such as beer, from a container. More particularly, the invention has to do with such an assembly which includes a hand pump to pressurize the container, the pump including a plunger sliding in a cylinder which communicates with a gas tube projecting into the container. A hollow boss rigid with the assembly provides a connection for a draft tube which also projects into the container and the beverage is dispensed through the draft tube, the boss, a tubular hose fitting communicating with the interior of the boss and a hose attached to the fitting.

With prior assemblies of this type, it has been possible for a user either to disable or to by-pass the hand pump and to connect the gas tube to another pressure source such as a tank of air under pressure. This presents a danger in that the user may neglect to use a pressure regulator or not set such a regulator properly with the result that the beverage container may become over-pressurized and explode.

SUMMARY OF THE INVENTION

The general object of the invention is to provide a new and improved pump and tap assembly which effectively precludes the operation of the assembly with any pressure source other than the hand pump of the assembly.

A more detailed object is to achieve the foregoing by forming the cylinder, its bottom wall, the gas tube, the boss and the hose fitting as a unitary and integral part so that it is virtually impossible to by-pass the hand pump and use an alternate pressure source.

The invention also resides in the novel construction and arrangement of the various components of the unitary parts of the assembly.

DETAILED DESCRIPTION OF THE PREFERRED EMBODIMENT

Figure 1:
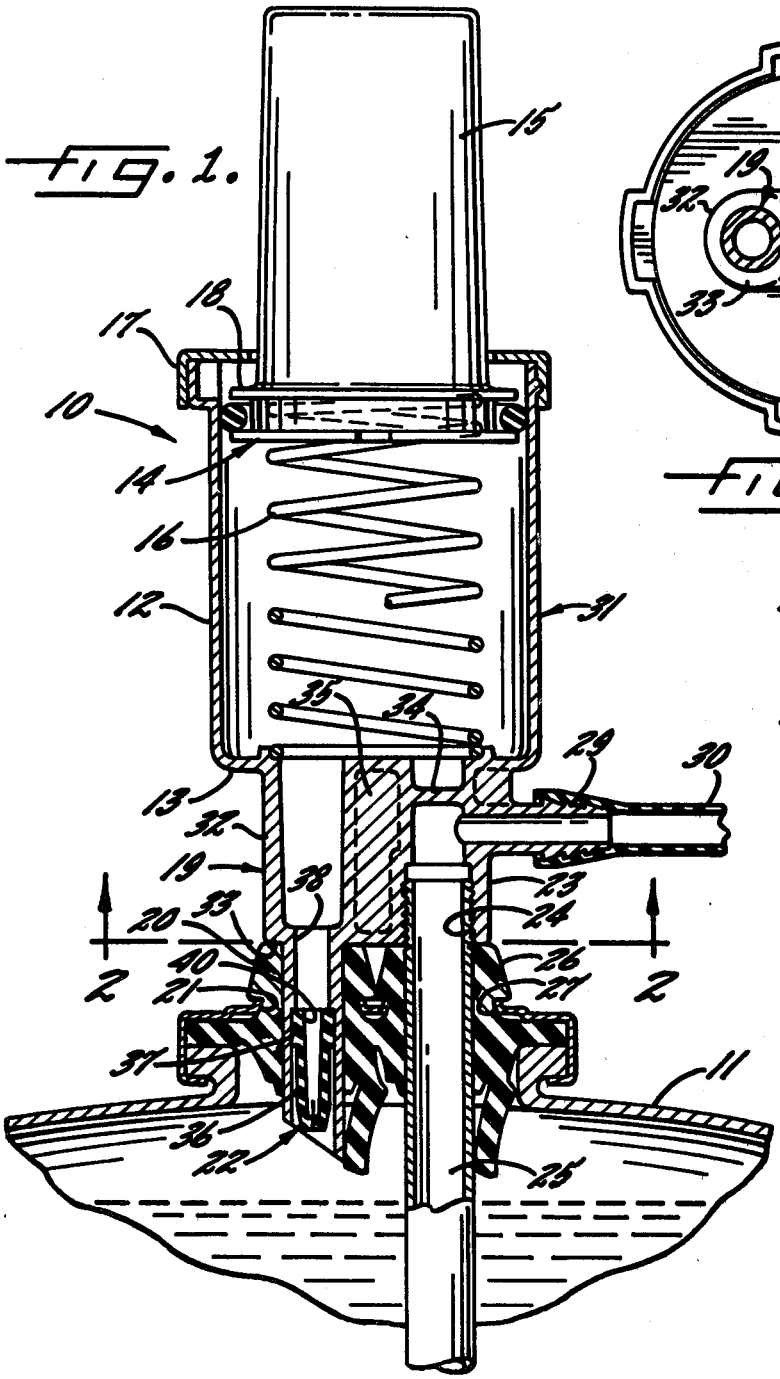
FIG. 1 is a longitudinal sectional view of the pump and tap assembly embodying the present invention with the assembly being shown in operative relationship with a beverage container.
Figure 2:
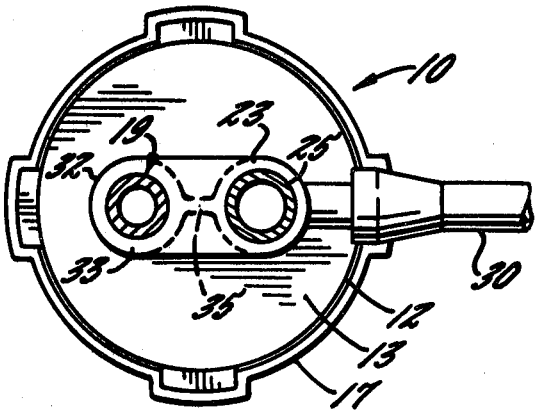
FIG. 2 is a sectional view taken along the line 2—2 of FIG. 1.

As shown in the drawings for purposes of illustration, the invention is embodied in a hand-operated pump and tap assembly 10 for use with a beverage container 11 that may contain draft beer or other carbonated beverages. The assembly includes a cylinder 12 closed at its lower end by a bottom wall 13 and receiving an annular piston or plunger 14 which reciprocates in the cylinder 12 and which is of any suitable construction well-known in the art. A tubular hand piece 15 rigid with the plunger 14 projects up through open upper end of the cylinder and is depressed manually to move the plunger down toward the bottom wall 13. When the hand piece is released, the plunger is moved back up by a coiled compression spring 16 acting between the underside of the plunger and the inner surface of the bottom wall 13. To limit the upward movement of the plunger, an annular cap 17 loosely encircles the hand piece 15 and snaps onto the upper end of the cylinder 12 and a radial flange 18 rigid with the hand piece above the plunger and forming part of the plunger abuts the cover and defines the upper limit of the movement of the plunger.

Projecting longitudinally downwardly from the bottom wall 13 is a relatively short and rigid gas tube 19 which communicates with the interior of the cylinder 12 through the bottom wall. Herein, the tube is offset from the axis of the cylinder and, in use, the tube projects into the container 11 through a seal 20 seated in an opening 21 in the container. An elastomeric one-way "duck bill" valve 22 made of a material such as silicone rubber is fitted in the gas tube to permit air to be ejected from the cylinder and enter the container on the downward stroke of the plunger 14 while preventing the beverage and the air in the container from flowing into the cylinder on the return stroke of the plunger. Thus, the cylinder 12, the plunger 14, the tube 19 and the valve 22 constitute a pump which is manually operable to pressurize the container 11 with a gas, in this case, air.

Figure 3:
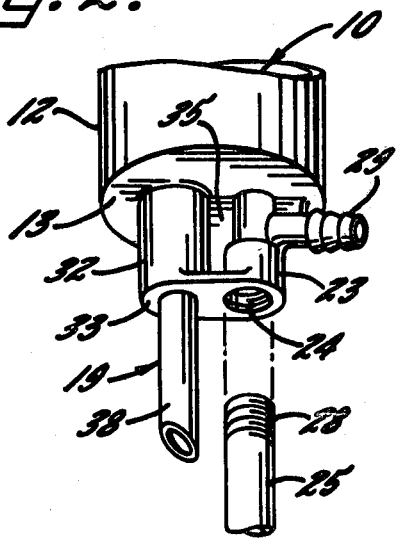
FIG. 3 is a fragmentary perspective view on a reduced scale of the assembly.

The assembly 10 also includes a hollow boss 23 beneath the bottom wall 13 of the cylinder 12 and the boss is formed with a downwardly opening hole or bore 24 to receive a rigid draw tube 25. The latter parallels the gas tube 19 and projects into the container 11 through a second seal 26 seated in another opening 27 in the container adjacent the seal 20. Herein, the draw tube is threaded into the bore 24 as indicated at 28 (FIG. 3) and the length of the tube is such that it extends just short of the bottom of the container. Projecting laterally of the boss 23 and communicating with the interior thereof is a tubular nipple or fitting 29 and the exterior of the fitting is tapered and serrated to receive one end of a hose 30. A conventional dispensing valve (not shown) is attached to the other end of the hose so that, when the beverage in the container 11 is under pressure and the valve is opened, the beverage flows out through the draw tube 25, the boss 23, the fitting 29, the hose 30 and the dispensing valve.

Heretofore, pump and tap assemblies of the general type described above have presented a safety hazard because, either by their inherent construction or by disassembling them, they can easily be modified by the user to disable the hand pump and to substitute a connection to a tank of gas under pressure. The danger arises in that the user may fail to use a pressure regulator with the gas tank or, even if a pressure regulator is used, it may be set at too high a pressure. As a result, the pressure of the air entering the container 11 may be so great that the container explodes. This is especially true in the case of containers made of comparatively light materials such as molded plastic.

In accordance with the present invention, the pump and tap assembly 10 is constructed in a novel manner so that it is tamper-proof in that the container 11 can be pressurized only by the hand pump, that is, by the manual reciprocation of the plunger 14 in the cylinder 12. This is achieved by making the cylinder, the gas tube 19, the boss 23 and the fitting 29 as a single integral part 31, preferably a molded plastic part, with the upper end of the gas tube terminating at the bottom wall 13 of the cylinder so that this tube does not project into the cylinder. As a result, there virtually is no place on the assembly 10 to attach a compressed gas cylinder to the gas tube even if the cover 17 and the plunger 14 are removed. Cutting or breaking the assembly to gain access to the gas tube disables the whole assembly for all practical purposes and, in the case of rentals, precludes return of a deposit.

To achieve the foregoing, the part 31 in the preferred embodiment is a single piece molded from a rigid plastic material such as nylon or Zytel. Thus, the bottom wall 13 is an inturned continuation of the side wall of the cylinder 12 and the ends of the gas tube 19 and the boss 23 merge continuously with the bottom wall. The upper end portion 32 of the gas tube terminates at the bottom wall and is enlarged to provide an external shoulder 33 which abuts the seal 20 and limits the penetration of the tube through the seal.

Herein, the boss 23 is a longitudinally extending tube molded integrally with the bottom wall 13 but the interior of the boss is separated from the interior of the cylinder 12 by an integral internal web 34 which extends across the bore 23 just below the bottom wall. Between the web and the threaded connection 28 with the draw tube 25 is the tubular fitting 29 which is molded integrally with the boss and projects laterally outwardly therefrom. The axial length of the boss is substantially equal to the length of the enlarged upper end portion 32 of the gas tube 29 so that the lower end of the boss abuts the seal 26 when the shoulder 33 on the gas tube engages the seal 20. For purposes of strength, an external web 35 joins the boss and the enlarged portion of the gas tube.

Figure 4:
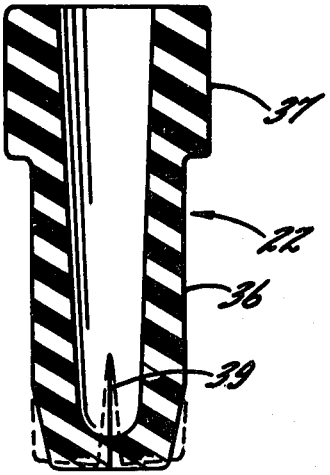
FIG. 4 is a longitudinal sectional view of a one-way valve used in connection with the assembly.

In order that the unitary part 31 may accommodate the one-way valve 22 and hold the latter in place during use, the valve includes a cylindrical body 36 with an elongated radial flange 37 (see FIG. 4) formed on the upper end portion of the valve. The valve is disposed in the reduced lower end portion 38 of the gas tube 19. At its lower end, the body portion of the valve is formed with a longitudinal slit 39 which opens on the downward stroke of the plunger as shown in broken lines FIG. 4 to permit air to flow from the cylinder 12 to the container 11 and, as the plunger retracts, the slit closes to prevent the air from returning to the cylinder. As illustrated in FIG. 1, the natural diameter of the radial flange 37 is greater than the internal diameter of the end portion 38 of the gas tube so that, when the valve 22 is in place, the flange is compressed and this compression holds the valve in position during both the downward and the return strokes of the piston. At the same time, the external diameter of the body 36 of the valve is appreciably smaller than the internal diameter of the gas tube end portion 38 to permit the slit 39 to freely open. The valve is inserted into the gas tube through the outer or lower end thereof by a suitable tool (not shown) and is properly located in the tube by having the flange 22 abut a downwardly facing internal shoulder 40 formed on the gas tube.

It will be observed that, with a pump and tap assembly embodying the invention described above, there is no place for a readily attaching a cylinder of gas under pressure to the gas tube 19 so as to substitute such a pressure source for the hand pump of the assembly. Moreover, the construction and arrangement of the gas tube and the boss 23 in conjunction with the bottom wall 13 of the cylinder 12 makes it impractical to cut the assembly apart while retaining parts which are usable with a pressure tank. As a result, the assembly effectively deters the substitution of such a tank which could present the dangerous situation of having no pressure regulator or an improperly set regulator.

We claim:

1. In a pump and tap assembly for a beverage container, the combination of, a single unitary piece of rigid plastic material and comprising, a cylinder having a first end open to receive a hand operated piston, and a tapping unit formed integrally with the second end of said cylinder, said tapping unit including a bottom wall portion formed integrally with said cylinder and closing said second end of the cylinder, a first rigid tube formed integrally with said bottom wall portion and projecting longitudinally outwardly from said bottom wall portion, said tube having an enlarged portion of predetermined length adjacent said bottom wall portion and communicating with the interior of said cylinder while terminating at said bottom wall portion thereby to permit air to be pumped from said cylinder into the container through said tube, the outer end portion of said first tube having an internal diameter of predetermined size, a hollow tubular boss integrally formed on the exterior of said bottom portion and projecting longitudinally from said bottom wall portion alongside said tube a distance equal to said predetermined length, the outer end of said boss having a hole facing longitudinally outwardly to receive and hold a second rigid tube generally paralleling said first tube, a web integral with and extending across the interior of said boss to separate the interior of the boss from the interior of said cylinder, a tubular fitting formed integrally with said boss and projecting laterally therefrom, said fitting communicating with the interior of said boss and adapted to receive a hose whereby beverage in the container flows out through said second tube, said boss, said fitting and said hose, and a separate and elongated one-way valve made of elastomeric material and disposed in said outer end portion of said first tube, said valve having a generally cylindrical body with a radial flange at its outer end, said body extending longitudinally of said first tube and having a slit which is adjacent its outer end and which opens to permit air to flow only in the direction from said cylinder to the container, the natural diameter of said radial flange of said valve being greater than the internal diameter of said outer end portion of said first tube whereby the flange is compressed against the inside of said first tube to hold the valve in place as said piston moves back and forth in said cylinder.

* * * * *